US006446551B1

(12) United States Patent
Watanabe

(10) Patent No.: US 6,446,551 B1
(45) Date of Patent: Sep. 10, 2002

(54) METHOD, APPARATUS, AND PLATE FOR STENCIL PRINTING HAVING REVERSIBLY EXPANDING AND SHRINKING APERTURES

(75) Inventor: Hideo Watanabe, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/414,865

(22) Filed: Oct. 8, 1999

(30) Foreign Application Priority Data

Oct. 9, 1998 (JP) ..... 10-287724

(51) Int. Cl.[7] ..... B41C 1/14; B41L 13/04

(52) U.S. Cl. ..... 101/128.4; 101/127; 101/128.21; 101/129; 101/487; 101/119

(58) Field of Search ..... 101/127, 128.21, 101/128.4, 129, 487, 114, 119, 120; 347/213; 346/140.1

(56) References Cited

U.S. PATENT DOCUMENTS 5,085,933 A * 2/1992 Katoh et al. ..... 428/332
5,133,919 A * 7/1992 Hasegawa et al. ..... 101/114
5,517,913 A * 5/1996 Oshio et al. ..... 101/119
5,617,787 A * 4/1997 Takita et al. ..... 101/128.4
6,145,976 A * 11/2000 Suzuki et al. ..... 347/91

FOREIGN PATENT DOCUMENTS

EP 0 406 884 A2 1/1991
GB 1 357 988 6/1974
GB 2329871 A * 7/1999
JP 59-207285 * 11/1984 ..... 101/128.4
JP 04369539 A * 12/1992
JP 10278217 A * 10/1998

* cited by examiner

*Primary Examiner*—Leslie J. Evanisko
(74) *Attorney, Agent, or Firm*—Fitch, Even & Tabin & Flannery

(57) ABSTRACT

A regenerable stencil printing plate is provided, which can be repeatedly used in master making and printing. The stencil printing plate comprises a film made of a polymeric material that shrinks in response to a stimulus selected from heat and light, and numerous fine apertures are formed in the film in cross sectional direction thereof. Preferably, the polymeric material is mainly composed of a polymer selected from acrylamide based polymers, vinyl ether based polymers, and oxide based polymers. Stencil printing is performed by providing the film, giving the above stimulus to the film in such a manner that a desired image is traced on the film to expand said apertures selectively at sites to which said stimulus is given, and allowing an image forming material to pass through the thus expanded apertures to transfer the image forming material to a recording medium. The stencil printing plate can constitute an outer circumferentical surface of an ink-permeable cylindrical printing drum used in a conventional stencil printing apparatus. The plate can be regenerated by a means for giving the plate a stimulus capable of expanding the polymeric material to narrow the expanded apertures of the plate.

21 Claims, 1 Drawing Sheet

METHOD, APPARATUS, AND PLATE FOR STENCIL PRINTING HAVING REVERSIBLY EXPANDING AND SHRINKING APERTURES

TECHNICAL FIELD

The present invention relates to a stencil printing method and to an apparatus for the same, and more specifically relates to a stencil printing method using a novel type of plate having numerous fine apertures that expand or narrow in response to a stimulus selected from heat and light, and to an apparatus for the same.

BACKGROUND OF THE INVENTION

Commonly prevailing as a digital duplicator high in printing speed and low in running cost is a printing machine in which a master is produced by melt-perforating a thermoplastic resin film layer of a heat sensitive stencil sheet by use of a heating means such as a thermal printing head which generates heat in a dot-like pattern in accordance with character or image information converted into electric signals, and in which the stencil sheet is wound around a circumferential surface of a printing drum so that an ink is transferred from the printing drum to a printing sheet through the perforated stencil sheet.

The digital duplicator known in the art requires a device for storing and conveying the heat-sensitive stencil sheet as well as a used-stencil discharging device. When printing is performed based on a new original, a used-sheet must be discarded. Usually, the used-stencil is temporarily stored in a used-stencil discharge box, and then is disposed when the box is full of used-stencils. This is because, in the conventional stencil printing, stencil sheets used as printing plates cannot be regenerated or reused.

BRIEF SUMMARY OF THE INVENTION

An object of the present invention is to provide a novel stencil printing plate that can be used in place of conventional stencil sheets, thereby providing a novel stencil printing method and an apparatus for the same, which solve the aforementioned problems of the conventional technology, and which eliminate provision and disposal of heat-sensitive stencil sheets.

In accordance with the present invention, the object above is accomplished by a stencil printing method comprising providing a film which is made of a polymeric material that shrinks in response to a stimulus selected from heat and light, said film having numerous fine apertures in cross sectional direction thereof, giving said stimulus to said film in such a manner that a desired image is reproduced to expand said apertures selectively at sites to which said stimulus is given, and allowing an image forming material to pass through the thus expanded apertures to transfer the image forming material to a recording medium.

In other words, the printing method according to the present invention comprises providing a stencil printing plate comprising a film made of a polymeric material which shrinks in response to a stimulus selected from heat and light and in which numerous fine apertures are previously provided in the film in cross sectional direction thereof, obtaining a master by providing said stimulus to said film to trace a desired image thereon and thereby selectively expand the apertures, and transferring an image forming material to a recording medium by passing the image forming material through the expanded apertures of the thus obtained master.

Hence, in accordance with another aspect of the present invention, there is provided a stencil printing plate comprising a film which is made of a polymeric material that shrinks in response to a stimulus selected from heat and light, said film having numerous fine apertures in cross sectional direction thereof.

The stencil printing plate according to the present invention is characterized in that when the stimulus of heat or light is given to the film, the film of the plate shrinks. Thus, in response to the stimulus, the surface of the film shrinks while expanding the apertures so that an image forming material can easily pass through the apertures. Size of each of the apertures may be such that the image forming material is not easily passed therethrough when the film is not given the stimulus. More specifically, the size can be properly selected depending on the physical properties, e.g., viscosity, etc., of a printing ink or other image forming materials.

Preferably, the polymeric material constituting the present stencil printing plate is further characterized in that it expands in response to another stimulus. In this case, in response to this stimulus, the surface of the film expands to narrow the apertures, and thereby hinders the passage of the image forming material. Thus, such a polymeric material is advantageous in that the passage of image forming materials can be inhibited irrespective of viscosity and other physical properties of the image forming materials.

Accordingly, the apertures of the plate of the present invention can be reversibly switched from a state in which an ink is allowed to pass to a state in which the passage of the ink is hindered, in response to different types of stimuli. In other words, the apertures of the plate can be reversibly switched from an opened state to a closed state. Thus, the plate can be regenerated or prepared for re-use in the next printing by closing all of the apertures even after it is once made into a master and used for printing. In order to close the apertures and regenerate the plate, the stimulus given to shrink the polymeric material constituting the film only has to be removed to cancel out the shrinking state, or alternatively, the aforementioned another stimulus capable of expanding the polymeric material may be given to the film.

As described above, in the present invention, the plate can be used repeatedly; hence, use of conventional disposable heat-sensitive stencil sheets are not necessary. Thus, all the devices necessary for handling stencil sheets can be eliminated from conventionally used rotary stencil printing machines by applying the present plate to a printing drum of a rotary stencil printing machine with a proper master making function.

In accordance with still another aspect of the present invention, there is provided a stencil printing apparatus comprising an ink-permeable cylindrical printing drum which is rotary driven around its central axis and has the stencil printing plate according to the present invention on an outer circumferential surface thereof, a master making means which provides said film with a stimulus selected from heat and light so that said apertures are selectively expanded in accordance with a desired image, a squeegee means disposed to inscribe an inner circumferential surface of said printing drum such that an image forming material supplied to an inside of said printing drum is squeezed outwardly of said printing drum, and a pressing means which applies pressure to at least one of said printing drum and a printing sheet to bring them in close contact with each other while said printing sheet is being moved in synchronism with rotation of said printing drum, so that the image forming material is transferred to the printing sheet from the inside of the printing drum through the expanded apertures of the plate. To further facilitate regeneration of the plate, the stencil printing apparatus may further comprise a means for providing the plate with a stimulus which expands the polymeric material of the plate so that the expanded apertures of the plate are narrowed.

BRIEF DESCRIPTION OF THE DRAWINGS

Hereinafter, the present invention will be described in further detail with reference to the appended drawings, in which.

DETAILED DESCRIPTION OF THE PREFERRED EMBODIMENTS

Figure 1:
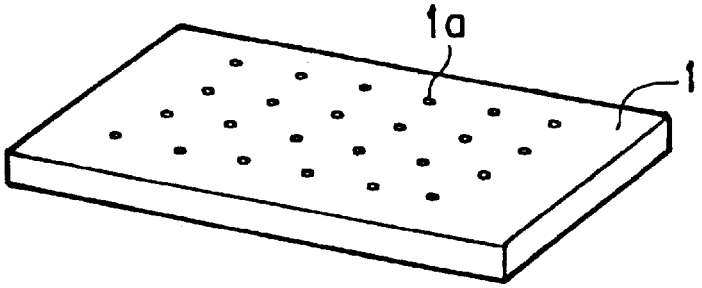
FIG. 1 is a schematically drawn perspective view of a plate for stencil printing according to the present invention, showing the apertures in closed state.

The polymeric materials which constitute the film of the plate according to the present invention can be selected from the materials that reversibly shrink by absorbing heat or light energy; for instance, there can be mentioned an acrylamide based polymer, a vinyl ether based polymer, and an oxide based polymer. More specifically, mention may be made of poly(N-isopropylacrylamide), poly(N-cyclopropylacrylamide), poly(N-ethylacrylamide), poly(N-methyl-N-ethylacrylamide), poly(N-methyisopropylacrylamide), poly(N-methyl-N-n-propylacrylamide), poly(N,N-diethylacrylamide), poly N-vinylisobutylamide), polyvinyl methyl ether, polyoxyethylene vinyl ether, polymethoxyethylene vinyl ether, polyethoxyethylene vinyl ether, polyethylene oxide, polypropylene oxide, etc. Among them, preferred are polymeric materials which are high in response speed to an applied stimulus of heat or light and also high in expansion coefficient and shrinkage coefficient on receiving the stimulus. If the response speed is low upon receiving a stimulus, it takes a long time to carry out printing based on a plurality of different image information, and thus efficient printing is not expected. Further, polymeric materials having a low expansion coefficient or shrinkage coefficient is economically disadvantageous, because a large amount of heat or light energy is necessary to open or shut the apertures. As favorable polymeric materials satisfying the preferred characteristics above, mentioned are poly(N-isopropylacrylamide) having a transition point of 32° C., poly(N-cyclopropylacrylamide) having a transition point of 45° C., poly(N,N-dimethylacrylamide) having a transition point of 32° C., poly(N-methyl-N-ethylacrylamide) having a transition point of 56° C., and polyvinyl methyl ether having a transition point of 38° C.; these polymeric materials shrink at a temperature higher than their respective transition points and expands at a temperature lower than the respective transition points.

The polymeric material may be composed of a single kind of polymer component or a blend of two or more components. Furthermore, in order to enhance the response to the stimulus or improve the expansion or shrinkage coefficient, the polymeric material may be a copolymer with other polymeric components. As the polymeric components, mentioned are, for instance, polyacrylic acid, poly(methyl methacrylate), poly(butyl methacrylate), polyacrylamide, poly(triethylamino acrylate), and polystyrene sulfonic acid. Also usable polymeric components are polar polymers, for example, polyvinyl pyrrolidone, ethylene-vinyl alcohol copolymer, polydioxolane, polyvinyl acetal, polyvinyl chloride, polyvinylidene chloride, polyvinyl fluoride, polyvinyl acetate, melamine resin, polyamide, polyimide, polyacrylamide, polyacrylonitrile, polyethylene imine, polyester, polycarbonate, polyurethane, polysulfoxide, polyphenylene sulfide, polyoxazoline, polyvinyl carbazole, etc.

To accelerate the response to heat or light, the polymeric material may additionally contain, for example, an inorganic compound, an organic compound, a metallic powder, a metal oxide, a pigment, or a dye. Among them, preferred are, for instance, carbon black, titanium oxide, calcium carbonate, silicon carbide, anthraquinone pigments, phthalocyanine pigments, azo pigments, cyanine dyes, and polyethylene dyes.

The film for use as the plate of the present invention can be obtained by making the above polymeric material into a film by means of a known method. For example, there can be mentioned a method comprising dissolving a film-forming principal polymer component in a solvent, and applying the thus-obtained solution to a removable support and drying; a method comprising polymerizing monomers on a removable support; or a method comprising forming a polymer film by use of a stretching machine. The thickness of the film is in a range of from 0.5 to 1,000 $\mu$m, and preferably, in a range of from 1 to 500 $\mu$m. A film thinner than 0.5 $\mu$m is inferior in handling properties and strength, and a film thicker than 1,000 $\mu$m not only requires a large amount of heat or light energy to open and shut the apertures, but also may cause difficulty in passing the image forming material.

The fine apertures of the film according to the present invention can be formed by using a perforating device, for example, an excimer laser irradiation device, an electron beam irradiation device, etc., in such a size that the image forming material for use in stencil printing cannot substantially pass through them, and in such a state that they penetrate through the film in a cross-sectional direction. When the film is shrinked, i.e., when the apertures are opened, the diameter of the apertures is, in general, in a range of from 0.1 to 500 $\mu$m. If the aperture is less than 0.1 $\mu$m in diameter, the image forming material is difficult to pass through it. If the aperture is more than 500 $\mu$m in diameter, resolution of prints obtained on recording media is low, causing printed image to be unclear.

The plate according to the present invention may be constructed from the aforementioned film alone, but to maintain mechanical strength, the film may be laminated to a porous support. As the porous support, mentioned are tissue paper, non-woven fabrics and screen gauze made from one or a mixture of fibers selected from natural fibers such as Manila hemp, pulp, paper mulberry, paperbush, and Japanese paper; synthetic fibers such as polyester, nylon, vinylon, and acetate; metallic fibers; and glass fibers.

The plate according to the present invention can be made into a printing master by giving the film a stimulus selected from heat and light. When the plate once made into a master is regenerated, the film only has to be cooled if the polymeric material of the film shrinks by heat, or the film may be subjected to heat or an electric field if the polymeric material of the film shrinks by light.

In order to make a master from the plate according to the present invention, a stimulus selected from heat and light is given to the film in such a manner that a desired image is traced on the film by the stimulus. A heat stimulus can be applied to the film, for instance, by a method comprising bringing a thermal pen or a thermal printing head comprising an array of a plurality of dot-like heat generating elements in contact with the film, or by a method comprising transferring a photothermal conversion material to the film by ejecting it onto the film in accordance with image information, and then irradiating a visible or infrared ray to the film to allow the photothermal conversion material to generate heat. As a light stimulus, usable is irradiation of ultraviolet light, visible light, or infrared light. An applicable irradiation method is, for instance, a method comprising providing a light stimulus to the entire film whilst non-image portions are light-shielded, or a method comprising applying a focused light to the film by use of a laser radiation. In case the polymeric material undergoes shrinking by both heat and light stimuli, the plate may be made into a master by use of a combination of both stimuli according to the methods mentioned above.

In the present invention, printing can be performed in accordance with a general method of stencil printing after the plate is processed into a master in the manner described above. For instance, an image forming material such as an ink is placed on one side of the master while superposing a recording medium such as a printing sheet on the other side, and then a pressure is applied by an aid of a pressing mechanism such as a press, a decompression device or a squeegee so as to allow the ink to pass through the expanded apertures of the plate and transfer to the recording medium.

The image forming material includes a liquid printing ink, a solid powder, and an image forming precursor. As the liquid ink, mention may be made of an oil ink, an aqueous ink, a water-in-oil (w/o) emulsion ink, an oil-in-water (o/w) emulsion ink, and a hot-melt ink. As the solid powder, mention may be made of a toner used in electrophotographic copiers, and a magnetic powder. As the image forming precursors, mention may be made of a reactive dye and a chelate color former.

The recording media include printing paper, plastic sheets, plates made of wood, metal or the like, and an article containing a compound to be reacted with the aforementioned image forming precursor.

EXAMPLE

The present invention is described in further detail below by way of a specific example referring to the drawings, but it should be understood that the present invention is by no means limited thereto.

FIG. 1 is a schematically drawn perspective view of a stencil printing plate according to the present invention, showing the apertures in closed state. In FIG. 1, a plate denoted by the numeral 1 is composed of a single film made of a polymeric material which shrinks in response to a stimulus of heat or light, and numerous fine apertures 1*a* are uniformly formed in the cross sectional direction. In this state, the opening of the apertures 1*a* has a size that is small sufficiently to prevent passage of image forming materials.

Figure 2:
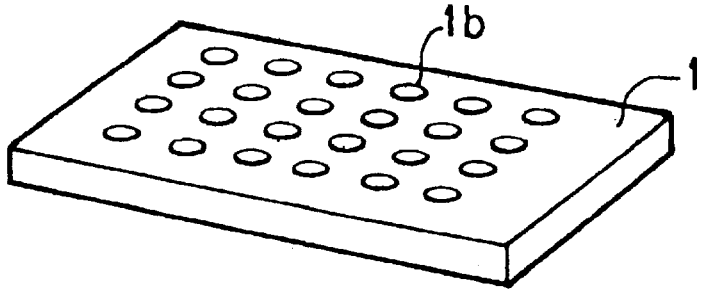
FIG. 2 is a schematically drawn perspective view of a plate for stencil printing according to the present invention, showing the apertures in opened state.

FIG. 2 is a schematically drawn perspective view which shows that the plate 1 of FIG. 1 is given a stimulus of heat or light. In this state, the apertures 1*b* are opened because the surface of the film around the apertures 1*b* shrinks, and the image forming material is allowed to pass through the apertures 1*b*. Thus, by placing an image forming material on one side of the plate 1 while bringing a recording medium in contact with the other side and pressing the image forming material against the recording medium, the image forming material is transferred to the recording medium through the apertures 1*b*. It can be seen clearly from the above that, by selectively opening and closing the apertures in accordance with a desired image, the present plate can be used in place of stencil sheets that have conventionally been used in various types of stencil printing apparatus. The plate 1 is preferably extended on a frame and fixed thereto on each side thereof, or fixed on a printing drum of a rotary stencil printing apparatus by use of a proper fixing means, so that the profile dimension of the plate does not change by the shrinkage and expansion of the polymeric material.

When another stimulus which expands the plate 1 of FIG. 2 is given to the plate 1, the plate 1 recovers the state shown in FIG. 1, and the plate 1 is regenerated to inhibit the passage of the image forming material through the apertures 1*a*. Since the plate 1 can reversibly repeat shrinking and recovery in the above-mentioned manner, the apertures can be reversibly opened and closed. Thus, the plate 1 can be used in master making and printing repeatedly.

Figure 3:
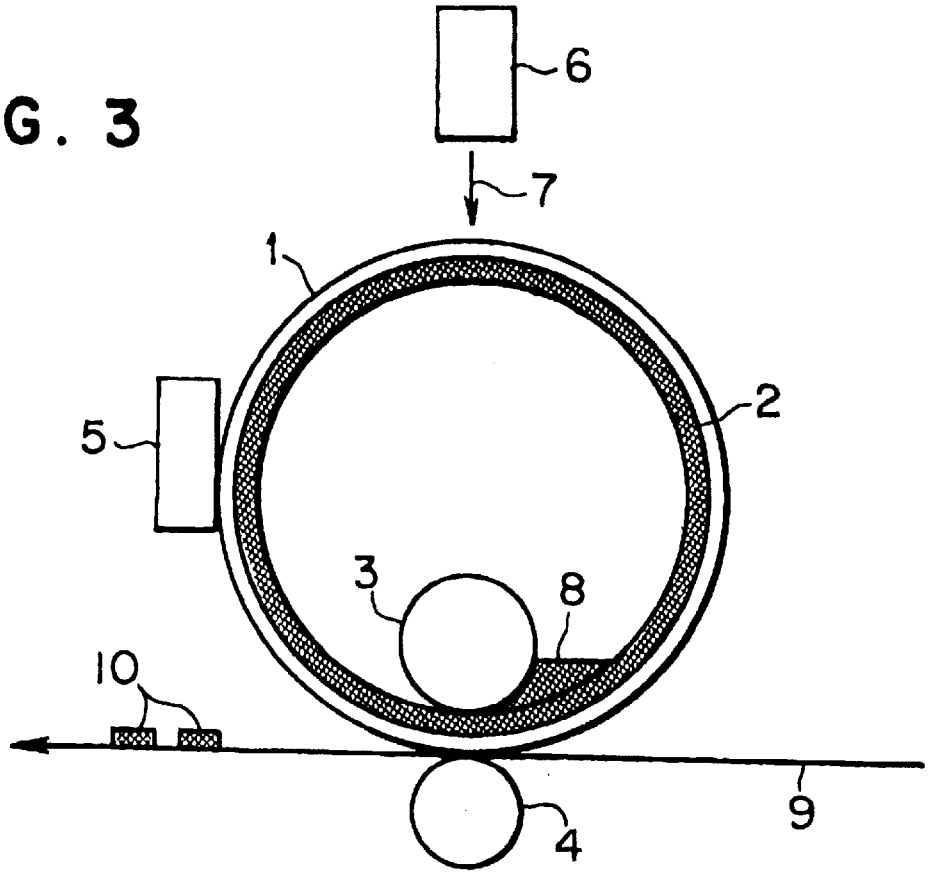
FIG. 3 is a schematically drawn cross-sectional view showing an embodiment of a stencil printing apparatus equipped with a printing drum having a plate for stencil printing according to the present invention.

FIG. 3 is a schematically drawn cross-sectional view showing an embodiment of a rotary stencil printing apparatus which practices the present printing method. The printing apparatus of FIG. 3 comprises a cylindrical printing drum 2 which is rotary driven about a central axial of the drum. The printing drum 2 comprises such an ink-permeable cylindrical porous member as used in conventional printing apparatus, and comprises the plate 1 shown in FIGS. 1 and 2 which is layered on an outer circumferential surface of the cylindrical porous member. The plate 1 used in the apparatus is made from a polymeric material, specifically, poly N-isopropylacrylamide), which shrinks by light and expands by heat. Furthermore, a squeegee roller 3 is disposed inside the printing drum 2 to inscribe an inner circumferential surface of the cylindrical porous member, and is rotary driven in the same direction as the printing drum 2 when printing is carried out.

Further, the apparatus of FIG. 3 is equipped with a light irradiating means 6, more specifically, a laser irradiating means, which is placed adjacent to the printing drum 2. The light irradiating means 6 can irradiate light onto a surface of the plate 1 selectively, so that an image is traced on the surface in accordance with image information previously converted into an electric signal. The apparatus shown in FIG. 3 is also equipped with a heating and cooling means 5 placed in contact with the outer circumferential surface of the printing drum 2. The heating and cooling means 5 can expand the polymeric material of the plate 1 by cooling the outer circumferential surface of the printing drum 2, and, if necessary, may pre-heat the plate 1 before the plate 1 is subjected to the irradiation of light so that the plate 1 is smoothly processed into a printing master by the irradiation.

Printing can be performed by using the apparatus of FIG. 3 as follows. First, while the printing drum 2 is properly rotated, the plate 1 is uniformly cooled to a temperature not higher than the transition temperature using the heating and cooling means 5. Then, by use of the light irradiating means 6, light 7 is irradiated to the surface of the plate 1 selectively in such a manner that a desired image is traced on the plate 1. Then, a master is produced since portions of the plate 1 to which light has been irradiated shrink, and the apertures in the vicinity of the above portions open to allow a printing ink 8 supplied to the inside of the printing drum 2 to pass through the apertures. When a printing sheet 9 is pressed by a press roller 4 against the plate 1 while being conveyed in synchronism with rotation of the printing drum 2, the printing ink 8 is pressed to the outside of the printing drum 2 by a squeegee roller 3, and at the same time, is transferred to the printing sheet 9 through the opened apertures of the plate 1. Thus, a printing image 10 is obtained on the printing sheet 9.

When another printing is performed in accordance with different image information in the apparatus shown in FIG. 3, the surface of the plate 1 is uniformly cooled to a temperature not higher than the transition temperature by use of the heating and cooling means 5. Thus, the plate 1 expands, and as a result, the apertures are closed to regenerate the plate 1. Then, by selectively irradiating light to the surface of the plate 1 in accordance with the different image information by use of the light irradiating means 6 to trace the desired image on the plate, the apertures are opened in accordance with the different image. Thus, similar to the above case, this different image can be printed by conveying a printing sheet 9 in synchronism with the rotation of the printing drum 2 while the sheet 11 is pressed against the plate 1 by the press roller 4.

According to the present invention, a regenerable stencil printing plate is provided, which can be repeatedly used in master making and printing. Thus, the stencil printing apparatus can abolish use of stencil sheets, and can eliminate such members as conventionally required for storing, conveying, and disposing stencil sheets. Accordingly, the present invention makes it possible to render a printing apparatus small-sized and contributes to reduction of wastes.

Although the present invention has been described in terms of a specific embodiment thereof, it is possible to modify and alter details thereof without departing from the spirit and scopes of the present invention.

What is claimed is:

1. A stencil printing method comprising:

(a) providing a film having numerous fine apertures in a cross sectional direction thereof, said film being capable of shrinking upon exposure to a first stimulus selected from heat and light to at least widen said apertures and being capable of expanding upon removal of said first stimulus or upon exposure to a second stimulus different from said first stimulus to at least narrow said apertures, wherein said expanding and said shrinking are reversible, and said film comprises a polymeric material, (b) subjecting said film to the first stimulus selected from heat or light so that apertures are selectively expanded in accordance with a desired image, (c) allowing an image forming material to pass through the thus expanded apertures to transfer the image forming material to a recording medium.

2. The stencil printing method according to claim 1, in which said polymeric material is mainly composed of a polymer selected from the group consisting of acrylamide based polymers, vinyl ether based polymers, and oxide based polymers.

3. The stencil printing method according to claim 1, wherein after (c) said method further comprises (d) removing said stimulus or providing another stimulus to said film in a manner such as to contract said apertures which were previously selectively expanded.

4. The stencil method according to claim 1, wherein said method further comprises repeating at least (b) through (d).

5. A stencil printing plate comprising:

a film having numerous fine apertures in a cross sectional direction thereof, said film being capable of shrinking upon exposure to a first stimulus selected from heat and light to at least widen said apertures and being capable of expanding upon removal of said first stimulus or upon exposure to a second stimulus different from said first stimulus to at least narrow said apertures, wherein said expanding and said shrinking are reversible, and said film comprises a polymeric material.

6. The stencil printing plate according to claim 5, wherein said film contains an additive to accelerate response to at least one of said first stimulus or said second stimulus.

7. The stencil printing plate according to claim 5, wherein said additive comprises a metallic powder, an inorganic compound or an organic compound.

8. The stencil printing plate according to claim 5, wherein said additive comprises a metal oxide, a pigment or a dye.

9. The stencil printing plate according to claim 5, wherein said film is laminated to a porous support.

10. The stencil printing plate according to claim 5, wherein said polymeric material comprises at least one polymer selected from the group consisting of acrylamide based polymers, vinyl ether based polymers, and oxide based polymers.

11. The stencil printing plate according to claim 5, wherein said polymeric material is capable of shrinking upon exposure to heat as the first stimulus and expanding upon exposure to cooling as the second stimulus.

12. The stencil printing plate according to claim 5, wherein said polymeric material is capable of shrinking upon exposure to light as the first stimulus and expanding upon exposure to heat or electric field as the second stimulus.

13. A stencil printing apparatus comprising an ink-permeable cylindrical printing drum which is rotary driven around its central axis and having an outer circumferential surface, a stencil printing plate on said outer circumferential surface, said stencil printing plate comprising a film having numerous fine apertures in a cross sectional direction thereof, said film being capable of shrinking upon exposure to a first stimulus selected from heat and light to at least widen said apertures, said film being capable of expanding upon removal of said first stimulus or upon exposure to a second stimulus that is different from said first stimulus so as to at least narrow said apertures, wherein said expanding and said shrinking are reversible, and said film is comprised of a polymeric material, a master making means for providing said film with the first stimulus selected from heat and light so that apertures are selectively expanded in accordance with a desired image, a squeegee means disposed for inscribing an inner circumferential surface of said printing drum such that an image forming material supplied to an inside of said printing drum is squeezed outwardly of said printing drum, and a pressing means for applying pressure to at least one of said printing drum and a printing sheet to bring them in close contact with each other while said printing sheet is being moved in synchronism with the rotation of said printing drum, so that the image forming material is transferred to the printing sheet from the inside of the printing drum through the expanded apertures of the stencil printing plate.

14. The stencil printing apparatus according to claim 13, wherein said first stimulus is heat and said second stimulus is cooling and said polymeric material is capable of shrinking upon exposure to heat and expanding upon exposure to cooling.

15. The stencil printing apparatus according to claim 14, wherein said master making means is also capable of providing said film with a second stimulus of cooling so that apertures are selectively at least narrowed in accordance with the desired image.

16. The stencil printing apparatus according to claim 13, wherein said apparatus further comprises a means for providing said stencil plate with said second stimulus which is capable of expanding said polymeric material to at least narrow the expanded apertures of said stencil plate.

17. The stencil printing apparatus according to claim 13, wherein said polymeric material comprises at least one polymer selected from the group consisting of acrylamide based polymers, vinyl ether based polymers, and oxide based polymers.

18. The stencil printing apparatus according to claim 13, wherein said first stimulus is light and said second stimulus is selected from heat and electric field, and said polymeric material is capable of shrinking upon exposure to light and expanding upon exposure to heat or electric field.

19. The stencil printing apparatus according to claim 18, wherein said master making means selectively irradiates said film in accordance with the desired image.

20. The stencil printing apparatus according to claim 19, wherein said apparatus further comprises a means for providing said stencil plate with said second stimulus selected from heat or electric field to at least narrow the expanded apertures of said stencil plate.

21. A stencil printing apparatus comprising:

an ink-permeable cylindrical printing drum which is rotary driven around its central axis and having an outer circumferential surface, a stencil printing plate on said outer circumferential surface, said stencil printing plate comprising a film having numerous fine apertures in a cross sectional direction thereof, said film being capable of shrinking upon exposure to a first stimulus selected from heat and light to at least widen said apertures, said film being capable of expanding upon removal of said first stimulus or upon exposure to a second stimulus that is different from said first stimulus to at least narrow said apertures, wherein said expanding and said shrinking are reversible, and said film is comprised of a polymeric material, a master maker that subjects said film with the first stimulus selected from heat and light so that apertures are selectively expanded in accordance with a desired image, a roller that is capable of inscribing an inner circumferential surface of said printing drum such that an image forming material supplied to an inside of said printing drum is squeezed outwardly of said printing drum, and a press roller that applies pressure to at least one of said printing drum and a printing sheet to bring them in close contact with each other while said printing sheet is being moved in synchronism with the rotation of said printing drum, so that the image forming material is transferred to the printing sheet from the inside of the printing drum through the expanded apertures of the stencil printing plate.

* * * * *